United States Patent [19]

Friese et al.

[11] Patent Number: 4,799,932

[45] Date of Patent: Jan. 24, 1989

[54] OILING AGENTS BASED ON SULFOSUCCINIC ACID MONOAMIDES

[75] Inventors: Hans-Herbert Friese, Monheim; Uwe Ploog, Haan; Wolfgang Prinz, Monheim, all of Fed. Rep. of Germany

[73] Assignee: Henkel Kommanditgesellschaft auf Aktien, Dusseldorf, Fed. Rep. of Germany

[21] Appl. No.: 64,894

[22] Filed: Jun. 19, 1987

[30] Foreign Application Priority Data

Jun. 20, 1986 [DE] Fed. Rep. of Germany ..... 3620780

[51] Int. Cl.[4] ..... C14C 5/00

[52] U.S. Cl. ..... 8/94.23; 252/8.57

[58] Field of Search ..... 8/94.23; 252/8.57

[56] References Cited

U.S. PATENT DOCUMENTS

| | | | |
|---|---|---|---|
| 3,668,124 | 6/1972 | Cassella, Jr. | 8/94.23 |
| 3,749,669 | 7/1973 | Luvisi et al. | 8/94.23 |
| 4,309,176 | 1/1982 | Friese et al. | 8/94.23 |

FOREIGN PATENT DOCUMENTS

| | | |
|---|---|---|
| 3419405 | 5/1984 | Fed. Rep. of Germany . |
| 3507241 | 3/1985 | Fed. Rep. of Germany . |

OTHER PUBLICATIONS

Literal Translation from Elkington & Fife, 34 19 405 (D 7073) and 35 07 241 (D 7263).

Linder, "Tenside, Textilhilfsmittel, Waschrohstoffe", vol. II, p. 755, Wissenschaftl. Verlagsges. mbH, Stuttgart, 1964.

*Primary Examiner*—Paul Lieberman

*Assistant Examiner*—Willie J. Thompson

*Attorney, Agent, or Firm*—Ernest G. Szoke; Wayne C. Jaeschke; Mark A. Greenfield

[57] ABSTRACT

A method for imparting hydrophobicity and softness to leather and skins comprising treatment thereof with at least one sulfosuccinic acid monoamide of the formula $$\mathrm{HOOC{-}\underset{\underset{x}{|}}{CH}{-}\underset{\underset{y}{|}}{CH}{-}CONRR'}$$

wherein

R and R' are, independently, H or a $C_{12-24}$ alkyl, and one of x or y is $SO_2$ and the other is H; either alone, or in sequence or simultaneously with at least one other hydrophobicizing agent, at least one impregnating agent, or at least one neutral oil; as well as a composition having the above ingredients.

18 Claims, No Drawings

OILING AGENTS BASED ON SULFOSUCCINIC ACID MONOAMIDES

BACKGROUND OF THE INVENTION

1. Field of the Invention

This invention relates to oiling agents based on sulfosuccinic acid monoamides and to a method for their use to hydrophobicize leather and skins.

2. Statement of Related Art

Published German patent application No. 16 69 347 describes a process for oiling leather using sulfosuccinic acid esters emulsifiable in water. However, the leather is not waterproofed by this treatment.

In addition, published German patent application No. 34 19 405 describes oiling agents containing sulfosuccinic acid $C_{12-24}$ fatty esters in combination with certain anionic and/or non-ionic emulsifiers for the tanning of leather and skins. These oiling (dubbing/stuffing) agents, which are used in the tanning liquor, do not hydrophobicize the leathers and skins.

Published German patent application No. 35 07 241 describes a process for the production of waterproof leathers and skins using impregnating and/or hydrophobicizing oiling agents containing sulfosuccinic acid monoester salts with $C_{12-24}$ fatty residues. Leathers and skins are treated with these oiling agents after retanning in aqueous liquor and, after acidification, the oiling agents are fixed by addition of chromium and/or aluminium salts. The leathers and skins are distinguished by acceptable waterproof effects.

DESCRIPTION OF THE INVENTION

Other than in the operating examples, or where otherwise indicated, all numbers expressing quantities of ingredients or reaction conditions used herein are to be understood as modified in all instances by the term "about".

It has now surprisingly been found that leathers and skins treated with the oiling agents according to the invention based on sulfosuccinic acid monoamides have distinctly improved hydrophobic properties compared with the prior art as discussed in the foregoing.

Accordingly, the present invention relates to oiling agents based on sulfosuccinic acid monoamides useful for hydrophobicizing leathers and skins.

Preferred oiling agents contain sulfosuccinic acid monoamides in the form of their alkali and/or ammonium salts.

Salts of sulfosuccinic acid monoamides containing one or two $C_{12-24}$ (preferably $C_{14-22}$) linear and/or branched, saturated and/or unsaturated alkyl radicals in the amine components are particularly preferred.

The sulfosuccinic acid monoamides useful in this invention have the formula:

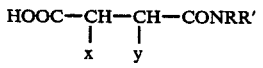

$$HOOC-\underset{x}{CH}-\underset{y}{CH}-CONRR' \quad (I)$$

wherein:

R and R' are, independently, H or a $C_{12-24}$ (preferably $C_{14-22}$) alkyl, and one of x or y is $SO_3H$ and the other is H; as well as alkali or ammonium salts thereof.

The sulfosuccinic acid monoamides are prepared in known manner by reacting equimolar quantities of maleic acid anhydride and the corresponding primary and/or secondary alkyl amines at around 50° to 65° C.

Following an after-reaction time at around 90° to 100° C., dependent on the quantities of reactants used, the reaction mixture is reacted with alkali and/or ammonium hydrogen sulfites or alkali and/or ammonium sulfites in a quantity substantially equimolar to maleic acid anhydride at around 80° to 100° C. (cf. for example Lindner: "Tenside, Textilhilfsmittel, Waschrohstoffe", Vol. II, p. 755, Wissenschaftl. Verlagsges. mbH, Stuttgart, 1964). The primary and/or secondary $C_{12-24}$ (preferably $C_{14-22}$) alkylamides used are linear and/or branched, saturated and/or unsaturated. Tallow and/or behenyl amine, for example, are preferably used.

The oiling agents according to the invention may contain sulfosuccinic acid monoamides as the sole component.

However, the oiling agents according to the invention preferably are compositions containing known hydrophobicizing and/or impregnating oiling agents and/or neutral oils as further components. This is because treatment with the mixed composition results in leathers and skins with extremely good softness, although the hydrophobicity may be somewhat reduced as compared to using the monoamides alone.

Suitable hydrophobicizing and/or impregnating oiling agents include oxidized and/or sulfoxidized $C_{16-30}$ hydrocarbons and/or $C_{32-40}$ waxes, $C_{12-24}$ alkyl phosphates with a linear and/or branched, saturated and/or unsaturated alkyl radical, polycarboxylic acid partial esters, for example citric acid partial alkyl esters containing from 16 to 24 C-atoms in the linear and/or branched, saturated and/or unsaturated esterification components and/or partial esters of polyalcohols, for example sorbitan, glycerol and/or pentaerthritol fatty acid esters containing from 12 to 24 C-atoms in the linear and/or branched, saturated and/or unsaturated alkyl chains of the fatty acid component.

Suitable neutral oils include: animal and/or vegetable fats and oils, such as neat's-foot oil, fish oil, tallow, soya oil, sunflower oil, palm oil and/or coconut oil, chlorinated and/or unchlorinated fatty acid methyl esters, for example chlorinated tallow fatty acid methyl ester, long-chain hydrocarbons and/or chloroparaffins.

According to the invention, oiling agents based on sulfosuccinic acid monoamides may also contain fats—and mixtures thereof—prepared by sulfatization, sulfonation, sulfitation, sulfochlorination or phosphatization of fats and/or oils. Oiling agents containing sulfosuccinic acid monoamides may contain up to about 40% by weight, based on active substance, of fats such as these. Leathers and skins treated with oiling agent mixtures of this type are distinguished from leathers and skins treated with oiling agents containing sulfosuccinic acid monoamides, (but no sulfatized, sulfonated, sulfited, sulfochlorinated and/or phosphatized fats) by possibly less favorable hydrophobic properties, but by extreme softness.

In the oiling agents according to the invention containing other components in addition to sulfosuccinic acid monoamides (oiling agent mixtures), the percentage of sulfusuccinic acid monoamides containing one or two $C_{12-24}$, preferably $C_{14-22}$ linear and/or branched, saturated and/or unsaturated alkyl radicals in the amine components, is 10 to 60, preferably 20 to 50, % by weight, based on active substance.

The oiling agents according to the invention may be in the form of pastes, aqueous emulsions or micro-emulsions.

The present invention also relates to a method for hydrophobicizing leather and skins, wherein (optionally dyed) leathers and skins (a) are treated with at least one oiling agent based on sulfosuccinic acid monoamides, as disclosed herein, and are then subjected to the following measures:
(b) if desired, treatment with at least one polyacrylate tannig agent,
(c) acidification to a pH of 3.8 to 4.2, and
(d) fixing of the oiling agents used in step (a) by addition of at least one polyvalent metal salt.

In the oiling agent compositions of this invention, the percentage of sulfosuccinic acid monoamides is 10 to 60, preferably 20 to 50, % by weight, based on active substance.

In the method according to this invention, (optionally dyed) leathers and skins are treated with at least one oiling agent based on at least one sulfosuccinic acid monoamide in aqueous liquor, at a temperature of 35° to 70° C., preferably 40° to 55° C. The agents (monoamide alone or composition) are employed minimally in an oiling agent-effective amount, although quantities of from about 3 to 15% by weight of oiling agents, based on active substance and on sheared or pelt weight, are preferred, depending upon the type of leather and/or skin to be treated. The pH of the fat-liquoring bath should be 4 to 8, preferably 4 to 6. The fat-liquoring step optionally may be followed by treatment with a known polyacrylate tanning agent before adjustment to a pH of 3.8 to 4.2, with an acid such as formic. The inventive oiling agents are then fixed with at least one polyvalent metal salt, particularly aluminium, chromium, titanium and/or zirconium salts, in aqueous form. The quantities in which the salts are used are minimally a fixing-effective amount, preferably between about 1 and 10% by weight, based on sheared or pelt weight.

In the method according to the invention, leathers and skins may be treated by adding all the components of the oiling agent in a mixed composition to the liquor. In some cases, however, it is of advantage to add the individual components of the oiling agent composition to the liquor successively. A more or less heavily pronounced waterproof effect may be obtained depending upon the percentage of hydrophobicizing and/or impregnating oiling agents.

The oiling agents according to the invention are taken up well by leathers and skins and are very uniformly distributed through the entire cross-section of the leather. In addition, the leathers and skins thus treated show pronounced water tightness. Importantly, compared with leathers and skins treated with oiling agents containing sulfosuccinic acid esters, leathers and skins treated with the oiling agents according to the invention show distinctly retarded water penetration and reduced water uptake. Also importantly the coloring of leathers and skins treated with the oiling agents according to the invention is more uniform and brighter when compared with leathers and skins treated with oiling agents containing sulfosuccinic acid monoesters.

EXAMPLES

I.no.=iodine number, A.no.=amine number, AS=active substance, mins.=minutes, h=hours.
"%" stands for "% by weight".

Example 1

Preparation of N-$C_{14-18}$-alkylsulfosuccinic acid monoamide, sodium salt 98.1 g (1 mol) maleic acid anhydride were introduced into a heatable 2-liter three-necked flask equipped with a stirrer, thermometer and heatable dropping funnel and melted at 55° to 60° C. After complete melting, 270 g (1 mol) tallow amine (dropping point: 30° C.) were added dropwise with slow stirring so quickly that a reaction temperature of 55°-60° C. was not exceeded. After an after-reaction time of 30 minutes at 95° to 100° C., 126 g (1 mol) anhydrous sodium sulfite, which had been dissolved in 900 g water, were added to the semiamide. After stirring for 2 hours at 85° to 90° C., a free-flowing dispersion containing approximately 35% active substance was obtained.

C-chain of the tallow amine used: approx. 5% $C_{14}$, approx. 30% $C_{16}$, approx. 65% $C_{18}$.
Further characteristics of the tallow amine used: I.-no.=43.5, A.no.=207.8

Example 2

Preparation of N-$C_{16-22}$-alkylsulfosuccinic acid monoamide, sodium salt

This compound was prepared in the same way as in Example 1.

C-chain of the behenylamine used: 15% $C_{16}$, 31% $C_{18}$, 10% $C_{20}$, 40% $C_{22}$.
Further characteristics of the behenylamine used: I.-no.=1, A.no.=188.

Example 3

Preparation N-$C_{14-18}$-alkylsulfosuccinic acid monoamide, ammonium salt

The corresponding monoamide was prepared as in Example 1 from 98.1 g (1 mol) maleic acid anhydride and 270 g (1 mol) tallow amine. The monoamide was then introduced at 20° to 40° C. into an aqueous solution containing ammonium hydrogen sulfite prepared by introduction of 64 g (1 mol) sulfur dioxide into a solution of 700 g water and 200 g 20% ammonia solution (approx. 1.1 mols ammonia) at 20° C. After stirring for 1 hour at 40° C. and then for 2 hours at 80° C., a free-flowing dispersion containing approx. 35% by weight active substance was obtained.

Application Examples

Hide upper leather:

Hide wet-blues (pH 3.8, sheared thickness: 1.8 mm) which have been chrome-tanned are further treated in the usual way, but without additions of anionic surfactants, as follows:

| | | |
|---|---|---|
| Washing: | 300% water 40° C. | 20 mins. |
| | drain off liquor | |
| Chrome retanning: | 200% water 45° C. | 30 mins. |
| | 2% Cr-tanning agent, 33% basic | |
| | 1% Na formate | 30 mins. |
| | drain off liquor, wash | |
| Dyeing/ retanning: | 150% water 40° C. | 40 mins. |
| | 1% neutral auxiliary tanning agent based on naphthalene-phenol condensate | |
| | 1.5% acidic dye | 30 mins. |
| | 4% polyacrylate tanning agent | 30 mins. |
| | 4% synth. tanning agent based on phenol condensate | 40 mins. |

-continued

| | | |
|---|---|---|
| | 4% chestnut | |
| | 2% masked chrome tanning agent | 30 mins. |
| | pH approx. 3.8 | |
| | drain off liquor, wash | |
| Oiling: | 200% water 50° C. | |
| One of the following oiling agents A-F was then added to the liquor. | | |
| (A) (invention) | 3.5% AS sulfosuccinic acid monoamide (amine component: $C_{14-18}$-monoalkylamine) Na salt | 45 mins. |
| (B) (prior art) | 3.5% AS sulfosuccinic acid mono-$C_{14-18}$-alkyl ester Na salt | 45 mins. |
| (C) (invention) | 2.1% AS sulfosuccinic acid monoamide (amine component: $C_{14-18}$-monoalkylamine) Na salt 3% neat's-foot oil | 45 mins. |
| (D) (invention) | 2.1% AS sulfosuccinic acid monoamide (amine component: $C_{14-18}$-monoalkylamine) $NH_4$-salt 3% neat's-foot oil | 45 mins. |
| (E) (prior art) | 2.1% AS sulfosuccinic acid mono-$C_{14-18}$-alkylester Na salt 3% neat's-foot oil | 45 mins. |
| (F) (invention) | 1.1% AS sulfosuccinic acid monoamide (amine component: $C_{16-22}$-monoalkylamine) Na salt 0.9% AS phosphoric acid mono-$C_{16-18}$-alkylester Na salt 1.2% neat's-foot oil | 45 mins. |
| followed by: | 3% polyacrylate tanning agent | 30 mins. |
| Acidification: | 1% formic acid | 30 mins. |
| Fixing: | 4% masked Cr tanning agent Drain off liquor, wash, finish. | 60 mins. |

Penetrometer test, 20° C.

Water penetration under 10% compression (longer is better)

| A | B | C | D | E | F |
|---|---|---|---|---|---|
| 60 mins. | 30 mins. | 160 mins. | 170 mins. | 100 mins. | >24 h |

Water uptake (less is better)

| | A | B | C | D | E | F |
|---|---|---|---|---|---|---|
| after 1 h | 25% | 66% | 13% | 15% | 35% | 11% |
| after 3 h | — | — | 42% | 44% | 76% | 18% |

Compared with prior art leathers B and E, leathers A and C showed distinctly retarded water penetration and reduced water uptake.

The coloring of leathers A and C was uniform and brighter compared with leathers B and E. In a visual comparison, leathers A, C, D and F achieved grade 5 and prior art leathers B and E grade 4 on an evaluation scale in which grade 1 = poor coloring and grade 6 = excellent coloring.

This conclusively demonstrates that the methods of this invention, and the inventive oiling agents, are superior to the prior art sulfosuccinic mono-$C_{14-18}$-alkyl esters, Na or $NH_4$ salts.

We claim:

1. A method comprising imparting hydrophobicity and softness by (A) treating said leather or skins by applying thereto minimally an oiling-effective amount of an agent consisting essentially of:

(1) at least one sulfosuccinic acid monoamide of the formula:

$$\mathrm{HOOC{-}\underset{\underset{x}{|}}{CH}{-}\underset{\underset{y}{|}}{CH}{-}CONRR'}$$

wherein

R and R' are independently H or a $C_{12-24}$ alkyl, and one of x or y is $SO_3H$ and the other is H; or an alkali or ammonium salt thereof.

2. The method of claim 1 further comprising the step of treating the oiled leather or skins with at least one polyacrylate treating agent.

3. The method of claim 1 further comprising the steps:

acidifying the oiled leather or skins to a pH of about 3.8–4.2; and further treating with at least one polyvalent metal salt.

4. The method of claim 1 wherein one of R or R' is alkyl.

5. The method of claim 1 wherein each of R and R' is, independently, alkyl.

6. The method of claim 1 wherein one of R or R' is a $C_{14-22}$alkyl and the other is H.

7. The method of claim 1 wherein each of R and R' is, independently, a $C_{14-22}$ alkyl.

8. The method of claim 3 wherein at least one polyvalent metal is aluminum, chromium, titanium, or zirconium.

9. A method for oiling leather or skins comprising imparting hydrophobicity and softness by (A) treating said leather or skins by applying thereto minimally an oiling-effective amount of an agent consisting essentially of:

at least sulfosuccinic acid monoamide or an alkali or ammonium salt thereof of the formula:

$$\mathrm{HOOC{-}\underset{\underset{x}{|}}{CH}{-}\underset{\underset{y}{|}}{CH}{-}CONRR'}$$

wherein

R and R' are independently H or a $C_{12-24}$ alkyl, and one of x or y is $SO_3H$ and the other is H;

in admixture with at least one other hydrophobicizing impregnating oiling agent, or at least one neutral oil which is an animal vegetable oil, said monoamide comprising about 10–60% by weight of the total agent.

10. The method of claim 9 wherein said monoamide is about 20–50% by weight of the total agent.

11. The method of claim 9 further comprising the steps of:

acidifying the oiled leather or skins to a pH of about 3.8–4.2; and further treating with at least one polyvalent metal salt, present minimally in a fixing-effective amount.

12. The method of claim 11 wherein one of R or R' is a $C_{14-22}$ alkyl and the other is H.

13. The method of claim 11 wherein each of R and R′ is, independently, a $C_{14-22}$ alkyl.

14. A composition for imparting hydrophobicity and softness to leather skins consisting essentially of (a) at least one sulfosuccinic acid monoamide oiling agent of the formula:

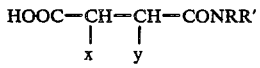

wherein

R and R′ are, independently, H or a $C_{12-24}$ alkyl; and one of x or y is $SO_3H$ and the other is H; or an alkali or ammonium salt thereof; and (b) at least one known other leather hydrophobicizing oiling agent, at lest one known leather impregnating agent, or at least one neutral oil which is an animal or vegetable oil;

both (a) and (b) being present in an oiling-agent-effective amount.

15. The composition of claim 14 wherein (a) is present in about 10–60% by weight of the combined weight of (a+b).

16. The composition of claim 14 wherein (a) is present in about 20–50% by weight of the combined weight of (a+b).

17. The composition of claim 14 wherein one of R and R′ is said $C_{12-24}$ alkyl, and the other is H.

18. The composition of claim 14 wherein each of R and R′ is, independently, said $C_{12-24}$ alkyl.

* * * * *